United States Patent [19]

Achterholt

[11] Patent Number: 4,993,312

[45] Date of Patent: Feb. 19, 1991

[54] AUTOMATIC HAND WEAPON

[76] Inventor: Rainer Achterholt, Sportplatzweg 7, Durach/Weidach, Fed. Rep. of Germany

[21] Appl. No.: 253,096

[22] Filed: Sep. 23, 1988

[51] Int. Cl.[5] ..... F41A 3/04

[52] U.S. Cl. ..... 89/155; 89/33.030

[58] Field of Search ..... 42/9, 15, 39.5, 59, 42/60, 68; 89/13.05, 13.1, 33.03, 155, 156, 157

[56] References Cited

U.S. PATENT DOCUMENTS

| | | | |
|---|---|---|---|
| 8,210 | 7/1851 | Porter | 42/60 |
| 143,729 | 10/1873 | Stensland | 89/13.1 |
| 1,294,636 | 2/1919 | Dovell | 89/13.05 |
| 2,972,286 | 2/1961 | Marquardt | 89/33.03 |
| 4,004,363 | 1/1977 | Sackenreuter et al. | 42/9 |
| 4,348,941 | 9/1982 | Ketterer et al. | 89/155 |

FOREIGN PATENT DOCUMENTS

| | | | |
|---|---|---|---|
| 73513 | 8/1944 | Czechoslovakia | 42/9 |
| 2401543 | 7/1975 | Fed. Rep. of Germany . | |
| 2730778 | 1/1979 | Fed. Rep. of Germany | 42/9 |
| 2813633 | 10/1979 | Fed. Rep. of Germany . | |

OTHER PUBLICATIONS

Military Technology, vol. XIII, issue 10, 1989, pp. 18–25.

*Primary Examiner*—Stephen C. Bentley

*Attorney, Agent, or Firm*—Pollock, Vande Sande & Priddy

[57] ABSTRACT

The barrel of an automatic hand weapon is held stationary in a weapon housing in which an axially symmetrical bore is formed perpendicularly to the barrel axis, a cylinder-shaped cartridge chamber housing being disposed within said bore and being adapted to be successively moved by positive intermittent rotary movement in the same direction about its axis of rotation into a firing position and a loading position. In order to permit improved matching with the ammunition, especially with an uncased cartridge and to permit, if necessary, the provision of an obturator at the projectile-side end of the cartridge chamber and optionally to increase the firing cadence, two cartridge chambers are formed in the cylinder-shaped cartridge chamber housing, said cartridge chambers being mutually disposed centrosymmetrically relative to the roational axis of the cartridge chamber housing.

9 Claims, 1 Drawing Sheet

AUTOMATIC HAND WEAPON

Figure 2:
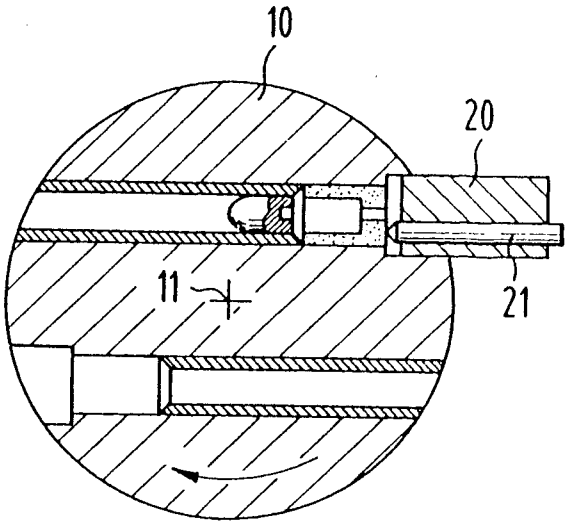

The invention is directed to an automatic hand weapon, especially a rifle, a pistol or a submachine gun. The weapon is particularly suited for firing uncased ammunition.

More in detail, the invention is directed to an automatic hand weapon comprising a barrel which is held stationary in a barrel portion in which an axially symmetrical bore is formed perpendicularly to the barrel axis, a cylinder-shaped cartridge chamber housing being disposed within said bore and being adapted to be successively moved by positive intermittent rotary movement in the same direction about its axis of rotation into a firing position in which a cartridge, especially an uncased cartridge, can be inserted from a magazine tunnel of a magazine mounted on the side of the weapon housing into a cartridge chamber within the cylinder-shaped cartridge chamber housing.

An automatic hand weapon of this type is known from DE-PS No. 2,813,633. The cartridge chamber housing of the known weapon, after rotation about 180° following a firing position, will again be in a firing position. To this end a single cartridge chamber is provided which is designed to be symmetrical to a transverse center plane of the cartridge chamber housing; the longitudinal axis of the cartridge chamber is aligned with a diameter of the cartridge chamber housing, and the rotary axis of the cartridge chamber housing intersects the axis of the bore of the barrel.

Although the control operations and sequences of movements are made uniform by the intermittent movement of the cartridge chamber housing which is always in the same direction of rotation, the known design also exhibits some drawbacks. Matching of the cartridge chamber with the ammunition to be used is not optimum because typically, a cartridge is not symmetrical with respect to its transverse center plane. In connection with uncased ammunition the especially high firing cadence, which is basically possible, is limited by rapid heating of the single cartridge chamber. Adapted obturators are not possible.

It is the object of the present invention to improve in an automatic hand weapon of the specified kind the positive intermittent drive of the cartridge chamber housing in the same direction after each rotation about 180° to a fresh firing position, and to retain the advantages resulting therefrom, while additionally improving the adaptation of the cartridge chamber to the projectile guiding function and the gas-tightness towards the striking pin. It is a further object of the invention to achieve a higher cadence. It is a still further object of the invention that the weapon is particularly adapted to the firing of uncased ammunition the projectile of which is movable relative to the propellant charge and is at least in part encompassed thereby.

Proceeding from an automatic hand weapon having the features specified above, the solution of the mentioned objects in accordance with the present invention is characterized in that in the cylinder-shaped cartridge chamber housing there are formed two cartridge chambers which are disposed mutually centrosymmetrically with respect to the rotational axis of the cartridge chamber housing. The two cartridge chambers are disposed within a cylinder section of the cylinder-shaped cartridge chamber housing, said cylinder section being in alignment with the axis of the bore. The rotational axis of the cartridge chamber housing is eccentric to the axis of the bore so that in any firing position the longitudinal axis of the respective cartridge chamber can be aligned with the axis of the bore. The cartridge-side end of each cartridge chamber may be provided with a per se known obturator which is adapted to the barrel diameter.

The cartridge chamber housing provided in accordance with the present invention includes two identical cartridge chambers which are designed to be centrosymmetrical relative to the rotational axis of the cartridge chamber housing and which are alternately in the firing position following a rotation of the cartridge chamber housing about 180°. While a cartridge positioned in one cartridge chamber is fired, the other cartridge chamber is allowed to cool. If necessary, such cooling can be enhanced by forced supply of cooling medium such as pressurized air. The cartridge feeder and the cartridge ejector may be arranged adjacent each other on the same side of the weapon housing; however, it is also possible to provide a spatially and functionally separate, relatively spaced arrangement. The cartridge ejector may always have a cleaning function for the currently aligned cartridge chamber while this will not affect the cadence.

Advantageous embodiments and improvements of the hand weapon in accordance with the invention will be apparent from the subclaims.

Thus, each cartridge chamber may comprise a wider portion for receiving the propellant charge of the uncased ammunition and a narrower bore section or an obturator for receiving the projectile. The narrower bore section is aligned with the barrel diameter. Wear-free sealing of the projectile-side end of the cartridge chamber and optimum guiding of the projectile are achieved. The configuration and movement of the breech block including the ignition means to the wider portion of the cartridge chamber is facilitated. In particular, excellent adaptation to uncased ammunition of the type is achieved which is movably arranged relative to the propellant charge and is at least partially encompassed thereby.

Preferably, a cartridge feeder comprising a first plunger and a second plunger is provided at the end of the magazine tunnel. In the loading position of each cartridge chamber a cartridge is inserted from the magazine tunnel into the cartridge chamber. The first plunger urges the propellant charge into the wider portion. The second plunger separates the projectile from the propellant charge and pushes the projectile into the narrower bore section. The hollow space formed within the propellant charge facilitates and accelerates uniform burning of the charge.

In accordance with a further advantageous embodiment the cartridge ejector is disposed adjacent to and at a slight distance from the cartridge feeder. Both devices act in the same direction. Little space is required on the weapon housing. The magazine tunnel, the cartridge feeder and the cartridge ejector may be disposed above the barrel portion. Non-fired cartridges are ejected downwardly and will not endanger the user.

Furthermore, the cartridge ejector may cooperate with a pressure conduit containing cooling medium for forcibly cooling the empty cartridge chamber which in a predetermined position is in alignment with the cartridge ejector. It is thereby possible to reduce the risk of premature explosion of the propellant charge of uncased ammunition. The weapon's cadence can be increased due to the fact that sufficient cooling of the cartridge chamber having a fresh cartridge introduced therein is always ensured. An example of a cooling medium is pressurized air which is produced either indirectly on the weapon by a gas pressure drive or by an externally driven motor.

Moreover, the cartridge ejector may additionally be equipped with cleaning means for the empty cartridge chamber which in a predetermined position is in alignment with the cartridge ejector. Such cleaning means can, for example, be a scraping or wiping means for removing unburnt residues from the cartridge chamber wall. It is exactly such hot residues of carbonization that involve the risk of spontaneous ignition of a fresh cartridge inserted into the cartridge chamber.

From DE-AS No. 2,401,543 there is already known an automatic hand weapon comprising a pivotable, cylinder-shaped cartridge chamber housing disposed perpendicularly to the axis of the bore, the rotational axis of said housing being eccentric relative to the axis of the bore. The known cartridge chamber housing not only performs an intermittent rotational movement in the same direction but is pivoted forwards and backwards in a 90° -step. To the extent to which three cartridge chambers can be formed in the known cartridge chamber housing, each cartridge chamber is formed in a different cylinder portion of the cylinder-shaped cartridge chamber housing and is associated with a separate barrel of a three-barreled weapon. The special advantages of the hand weapon according to the invention, such as rotational movement of the cartridge chamber housing in the same direction and possible cooling of the cartridge chamber currently not in use cannot be achieved with the known cartridge chamber housing.

Figure 1:
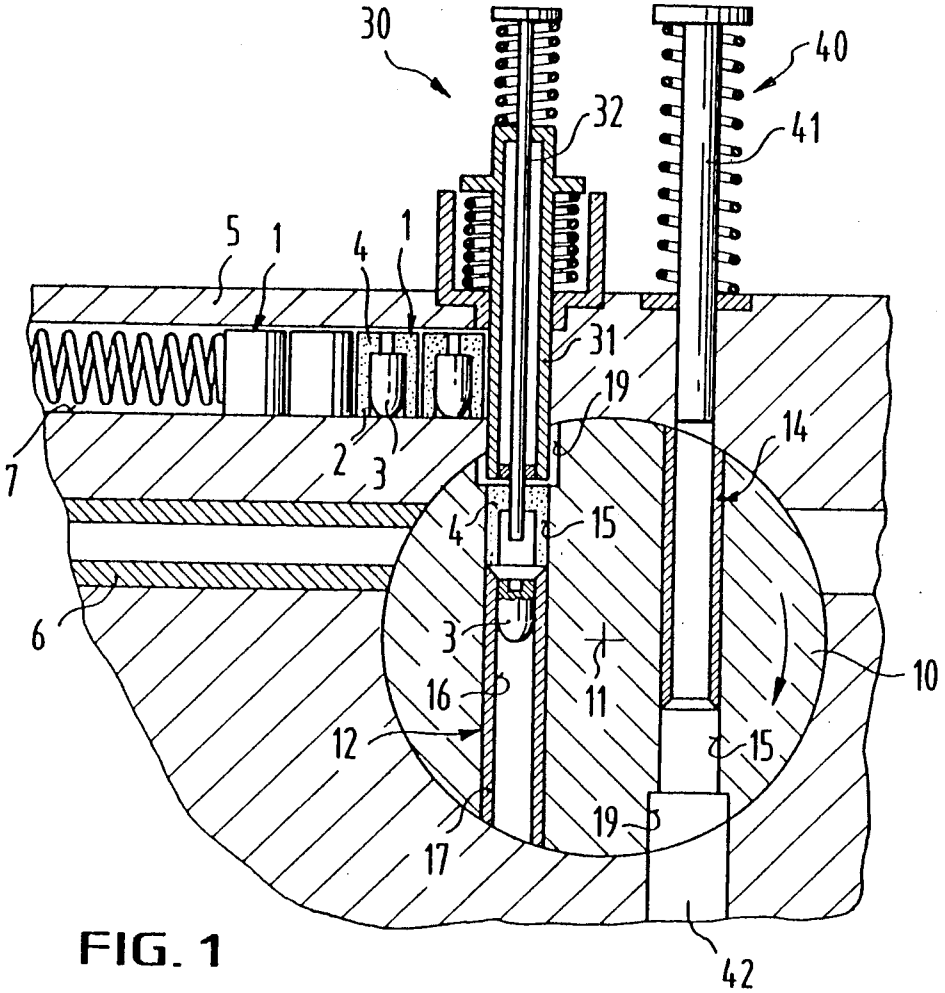

Below, a preferred embodiment of the invention will be described in detail with reference to the drawing, in which:

FIG. 1 is a schematic sectional view of a cartridge chamber housing as provided in accordance with the present invention within a partially illustrated weapon housing, adjacent the magazine tunnel including cartridge feeder and cartridge ejector; the cartridge chamber housing is in its loading position; and FIG. 2 is a schematic sectional view of the cartridge chamber housing of FIG. 1 in its firing position relative to the barrel of the weapon.

The fundamental design of an automatic hand weapon with pivotable cartridge chamber housing of the presently considered type is known to those in the art. Within a weapon housing a cylinder-shaped cartridge chamber housing is disposed in an axially symmetrical recess. The cylinder-shaped cartridge chamber housing can be driven in a controlled way through a disk cam which in its turn is powered by a gas pressure drive or an externally driven motor. Furthermore, the weapon housing has mounted thereon a barrel and a striking pin and cock remote from the barrel. As regards further details, reference shall be made, for example, to the prepublished references DE-AS No. 2,401,543 and DE-PS No. 2,813,633.

A significant aspect of the present invention resides in the configuration of the cylinder-shaped cartridge chamber housing 10. In a common cylinder portion aligned with the barrel, two cartridge chambers 12 and 14 are provided centrosymmetrically to the rotational axis 11 of the housing 10. Each cartridge chamber 12, 14 includes a wider portion 15 for accommodating the propellant charge 1 of an uncased cartridge 2 and a reduced-diameter or narrower bore section 16 for accommodating the projectile 3 of said cartridge 1. The narrower bore section 16 may be surrounded by an obturator 17 which provides for guiding of the projectile 3 and sealing of the projectile tunnel 16 relative to the barrel. The wider section 15 of each cartridge chamber 12, 14 is followed by an enlarged portion 19 into which in the firing position a breech block 20 with a movable striking pin 21 may enter. The clear interior cross-section of the wider portion 15 is matched with the external dimensions of the propellant charge 2 of the employed uncased cartridge 1 and may, for instance, be rectangular, especially square; it is especially preferred to provide a circular internal cross-section.

Within the weapon housing 5—preferably above the barrel 6—there is formed a magazine tunnel 7 in which a multiplicity of cartridges 1 is disposed which are forcibly advanced to a cartridge feeder 30. The cartridge feeder 30 includes two independently movable plungers 31 and 32. The plungers 31, 32 are preferably powered by schematically indicated springs, and control of each plunger can preferably be effected in a manner known per se through lobes (not illustrated) on a disk cam (not illustrated). In the illustrated embodiment the external plunger 31 concentrically surrounds the internal plunger 32. The external plunger 31 is used for introducing the entire cartridge 1 into the cartridge chamber 12 and especially urges the propellant charge body 2 into the wider portion 15 of the cartridge chamber 12. The internal plunger 32 is guided in a central bore 4 in the body of the propellant charge 2, separates the projectile 3 from the body of the propellant charge 2 and moves the projectile right into the narrower bore section 16 within the cartridge chamber 12. When the body of the propellant charge 2 and the projectile 3 have been disposed in the described way within the cartridge chamber 12, both plungers 31 and 32 are forcibly returned and the cartridge chamber housing 10 can be rotated clockwise about 90° from the illustrated loading position and will then assume the firing position illustrated in FIG. 2. In said firing position the narrower bore section 16 is in alignment with the firing passage within the barrel 6. A movable breech block 20 has been forcibly moved into the enlarged portion 19 and hermetically seals the wider portion 15 of the cartridge chamber 12. If necessary, known sealing means or a further obturator for closing the rear end of the cartridge chamber 12 may cooperate with the breech block 20. Within the breech block 20 an ignition means 21 is movably disposed which is indicated only schematically. After actuation of a trigger (not illustrated) the ignition means 21 will ignite the propellant charge 2, for example when a hammer impacts a priming cap whereby an electric spark is initiated, or by producing a flash of light.

After a shot has been fired, the cylinder-shaped cartridge chamber housing 10 is rotated clockwise by a further step of 90° when the second cartridge chamber 14 will assume the loading position. The first cartridge chamber 12, from which a shot has just been fired, is now aligned with a cartridge ejector 40. The cartridge ejector 40 comprises —in a manner known per se—at least one movably disposed plunger 41 which in this position can be moved into the empty cartridge chamber 12. As shown, the cartridge ejector 40 is disposed adjacent to and at a slight distance from the cartridge feeder 30. All of the plungers 31, 32 and act in the same direction and are readily controlled by a disk cam (not illustrated). Opposite the cartridge ejector 40 an ejection opening 42 is formed through which the case of a conventional cartridge or, in case of failure, the non-fired cartridge 1 can be ejected by means of the plunger 41. Although the cartridge chamber housing 10 including the two cartridge chambers 12 and 14, as provided in accordance with the present invention, offers special advantages in respect of shooting uncased ammunition and is preferably intended for this purpose, it is also possible with this cartridge chamber housing to fire conventional cartridges including a permanent cartridge case. It would then be advantageous that the ejecting function can be performed in the loading position of the cartridge chamber housing 10 and does not require any additional ejecting position.

Provision may be made for the plunger 41 of the cartridge ejector 40 to be actuated only in case of a failure. Alternatively, the plunger 41 can be forcibly actuated after each firing operation. In that case the plunger 41 may additionally be provided with scraping or wiping tools (not illustrated) for cleaning the cartridge chamber 14 after each shot. In particular, hot carbonization residues resulting from burning the previously ignited propellant charge can be removed whereby the risk of inadvertent spontaneous ignition upon insertion of a fresh uncased cartridge 1 into the cartridge chamber 14 is considerably reduced. Additionally, the cartridge ejector 40 may have a pressure conduit (not illustrated) connected thereto so as to blow cooling medium, especially pressurized air, through the empty cartridge chamber 14 while a fresh cartridge 1 is inserted into the adjacent cartridge chamber 12.

In a practical embodiment of the hand weapon according to the invention the cylinder-shaped cartridge chamber housing has a diameter of about 40 to 60 mm, especially a diameter of 55 mm. Within this cartridge chamber housing two cartridge chambers are formed centrosymmetrically to the rotational axis of said housing, the narrower bore section of said chambers having a diameter of about 5 mm. The wider portion has circular cross-section with an inside diameter of about 10 to 12 mm. The length of the wider portion is about 20 to 30 mm.

What is claimed is:

1. An automatic hand weapon comprising a barrel held stationary in a weapon housing and having an axially symmetrical bore located perpendicularly to the axis of the barrel; cylinder-shaped cartridge chamber housing being disposed within said bore and wherein said chamber housing is successively moved by positive intermittent rotary movement in the same direction about its axis of rotation into a firing position and into a loading position; and for receiving a cartridge from a magazine tunnel of a magazine mounted on the side of the weapon housing; and including two cartridge members located within said cylinder-shaped chamber housing wherein said two cartridge members are mutually disposed centrosymmetrically relative to the rotational axis of said cartridge chamber housing, wherein the intermittent rotary movement of the cartridge chamber housing is in 90° increments and wherein each of said cartridge members includes a loading opening at one end and a firing opening at the opposite end and is offset to the rotational axis of the cartridge chamber housing.

2. The hand weapon as claimed in claim 1, characterized in that each cartridge chamber (12, 14) includes a wider portion (15) for accommodating the propellant charge (2) of an uncased cartridge (1) and a narrower bore section (16) for accommodating the projectile (3) of said cartridge.

3. The hand weapon of claim 2 wherein following the same wider portion (15) is an enlarged portion (19) that receives a breech block when the cartridge chamber housing is in the firing position.

4. The hand weapon as claimed in claim 2 or claim 3 for firing uncased ammunition, the projectile of which is disposed movably relative to the propellant charge and is at least partially encompassed thereby, characterized in that the magazine tunnel (7) leads to a cartridge feeder (30) including a first plunger (31) and a second plunger (32); and in the loading position of the cartridge chamber housing (10), the first plunger (31) for urging the body of the propellant charge (2) into the wider portion (15); and the second plunger (32) for separating the projectile from the body of the propellant charge (2) to push it into the narrower bore section (16).

5. The hand weapon as claimed in claim 2 characterized in that an obturator (17) surrounds the narrower bore section (16) within the cartridge chamber housing (10).

6. The hand weapon as claimed in claim 4 characterized in that a cartridge ejector (40) is disposed adjacent to and at a slight distance from the cartridge feeder (30) to act in the same direction.

7. The hand weapon as claimed in claim 4 characterized in that an obturator (17) surrounds the narrower bore section (16) within the cartridge chamber housing (10).

8. The hand weapon as claimed in claim 3 characterized in that an obturator (17) surrounds the narrower bore section (16) within the cartridge chamber housing (10).

9. The hand weapon as claimed in claim 5 characterized in that a cartridge ejector (40) is disposed adjacent to and at a slight distance from the cartridge feeder (30) to act in the same direction.

* * * * *